United States Patent [19]

Blair

[11] 3,994,389

[45] *Nov. 30, 1976

[54] MAIL STACK FEED CONTROL

[75] Inventor: John E. Blair, Richardson, Tex.

[73] Assignee: Recognition Equipment Incorporated, Dallas, Tex.

[ * ] Notice: The portion of the term of this patent subsequent to Nov. 30, 1993, has been disclaimed.

[22] Filed: Aug. 17, 1973

[21] Appl. No.: 389,352

[52] U.S. Cl. ..... 198/719; 198/856; 271/149; 271/154

[51] Int. Cl.[2] ..... B65G 43/00

[58] Field of Search ..... 198/23, 106, 135, 168, 198/172, 173, 232, 37, 40; 271/47, 57, 149, 150, 152–155; 214/7, 8.5 A, 8.5 SS, 300, 312, 314

[56] References Cited

UNITED STATES PATENTS

| | | | |
|---|---|---|---|
| 2,252,469 | 8/1941 | Nyberg | 271/149 |
| 2,959,270 | 11/1960 | Heaton et al. | 198/37 |
| 2,963,177 | 12/1960 | Shields | 214/8.5 A |
| 3,363,782 | 1/1968 | Burkhardt et al. | 271/149 |
| 3,627,106 | 12/1971 | Winfield | 198/173 |

FOREIGN PATENTS OR APPLICATIONS

| | | | |
|---|---|---|---|
| 646,301 | 9/1962 | Italy | 214/7 |

*Primary Examiner*—Evon C. Blunk
*Assistant Examiner*—Joseph E. Valenza
*Attorney, Agent, or Firm*—John E. Vandigriff

[57] ABSTRACT

A stack of edge supported mail pieces delivered batchwise to a feed system requiring a continuous supply includes fingers moving the back of the stack with pressure responsive means in the fingers to discontinue the drive thereof when the pressure reaches a predetermined level.

2 Claims, 6 Drawing Figures

MAIL STACK FEED CONTROL

This invention relates to feed control for a stack of edge supported mail documents, and more particularly to preventing the application of drive pressure to the back of a mail stack above a predetermined level to prevent buckling of the stack.

In automatic mail handling systems, procedures adopted in the United States postal system includes canceling the stamp on each mail piece, facing all mail pieces in the same direction in a stack whereby the faced and canceled mail pieces may be sorted. Normally the stack of mail pieces is placed in a tray having a bottom and four upstanding sides. The documents are stacked as to be supported along the bottom edges thereof as they rest on the bottom of the tray.

Heretofore it has been proposed that documents be automatically unloaded from trays by inserting a pair of paddles into the ends of the tray, then drawing the paddles together to compress the stack of documents sufficient to permit them to be lifted out as a body. Mail pieces generally are of assorted sizes and thicknesses and varying quality of paper and thus are not readily amenable to such handling operations.

In accordance with the present invention, a system is provided for handling edge supported stacks of mail unloaded from a mail tray onto a slotted transport bed. A pair of ranks of upstanding fingers mounted to follow a closed course having an upper traverse arranged so that the tips of one rank of fingers extends up through the bed at a time to contact the rear of each stack. Motor means is provided to drive the fingers to push against the rear of each stack. Drive means also propels a trailing stack toward the fingers. Pressure responsive means at the contact between at least one finger in each rank and the trailing stack disables the drive means when the pressure on the finger reaches a predetermined level.

For a more complete understanding of the invention, reference may now be had to the following description taken in conjunction with the accompanying drawings in which.

In describing the invention of the present application, reference is made to U.S. Pat. No. 3,854,613 entitled "Batch to Continuous Flow Mail Handling" and U.S. Pat. No. 3,863,789 entitled "Mail Tray Unloading". The systems disclosed in these patents are used in conjunction with the invention of the present application.

In the Mail Handling System described in the two above mentioned patents, mail is delivered from a tray to a box 30 (FIG. 1) by inversion of the tray carrying the mail pieces and the box. When the box is returned to its normal upright position, the mail pieces rest on the bottom of box 30.

Figure 1:
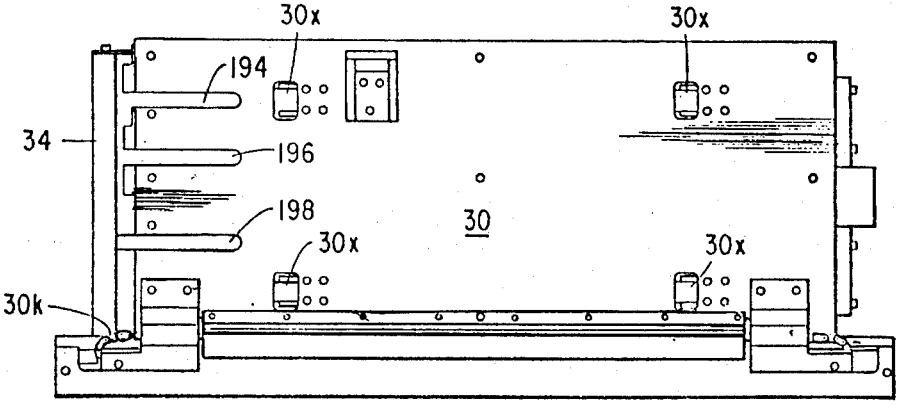
FIG. 1 is a bottom view of a turn over box utilized in the present invention.

In FIG. 1 the bottom of box 30 is characterized by four clutched rollers 30*x* over which the mail tray is to roll. Rollers 30*x* permit the tray to roll forward freely but will not roll in the opposite direction. Further, three slots 194, 196 and 198 are formed in the bottom plate of box 30, extending to the front lip of the bottom plate.

Figure 2:
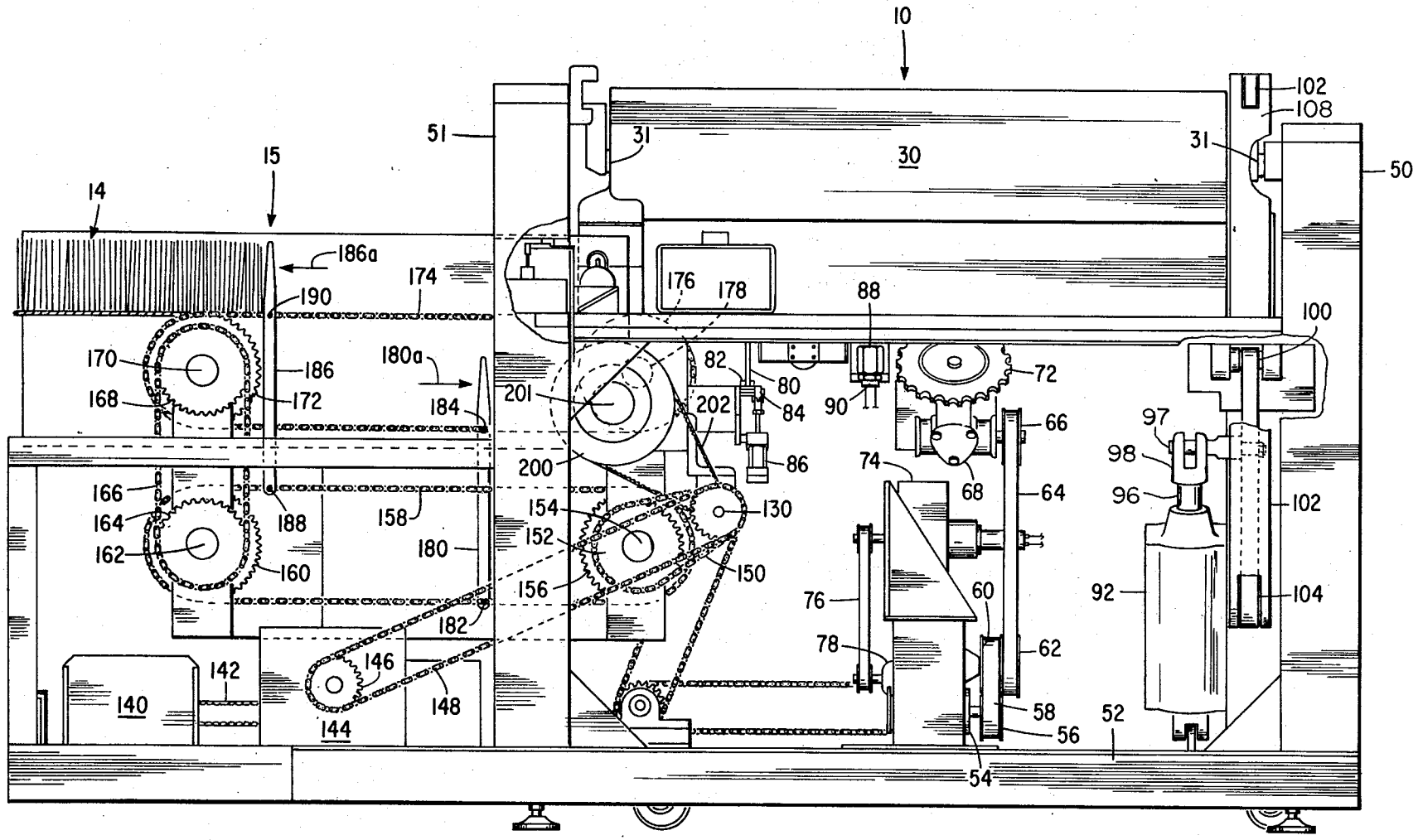
FIG. 2 is a front view of an unloader mechanism including the box of FIG. 1.
Figure 3:
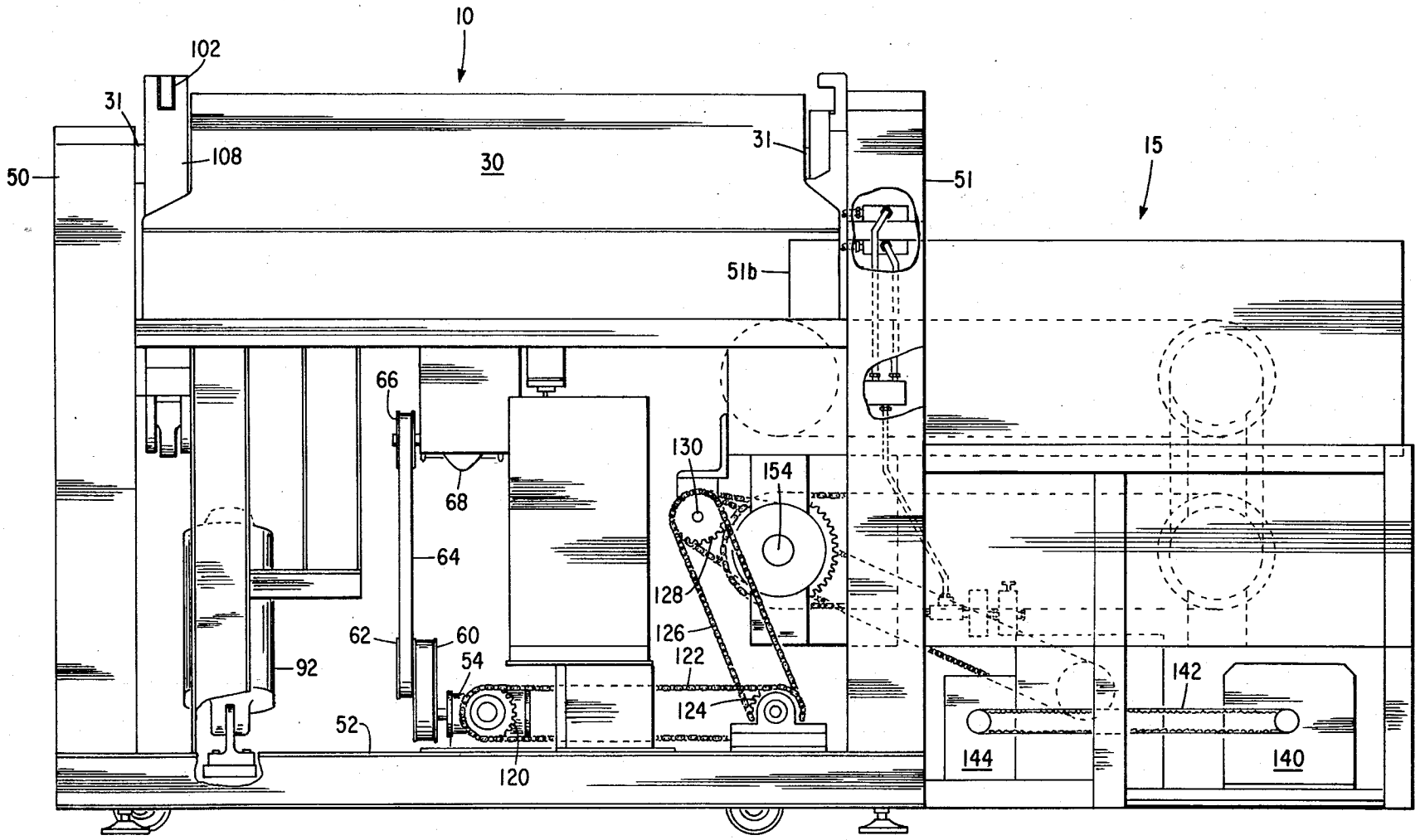
FIG. 3 is a rear view of the unit of FIG. 1.

Now that certain of the details of box 30 have been described, reference should be had to FIGS. 2–3 wherein the box 30 is incorporated in an actuating mechanism comprising unloader 10 which is shown in conjunction with the transition section 15.

In FIG. 2 box 30 is rotatably supported on axis 31 from standards 50 and 51. Standards 50 and 51 are supported from a base 52. Beneath box 30 and supported by base 52 are controls and drive means for actuation of the system. A motor 54 mounted on base 52 drives a pulley 56 which is coupled by a belt 58 to a pulley 60. Pulley 60 is mounted on the same shaft with a pulley 62 which is connected by way of belt 64 to the input pulley 66 on an angle gear drive 68. The output shaft of drive 68 supports a sprocket 72 which meshes with a chain (not illustrated), when the box 30 is in the upright position.

A servo control motor 74 is mounted immediately above motor 54 and is coupled by way of a belt 76 to the input of a gear box 78. Pulleys 60 and 62 are mounted on the output shaft of the gear box 78.

Motor 54 serves to drive sprocket 72 at a high speed preparatory to insertion of a mail tray into box 30 and to permit a new stack of documents in box 30 to catch up with the trailing end of the preceding stack. Servo control motor 74, actuated after motor 54 is deactuated, drives sprocket 72 at a low speed determined by the rate at which a stack of documents is fed into the system.

A bracket 80 is secured to the bottom of box 40 and extends downwardly therefrom supporting a roller 82 at the lower end thereof. Roller 82 engages a latch arm 84 which is under the control of a latching solenoid 86. When the solenoid 86 is energized, roller 82 is in a notch in arm 84 thereby preventing rotation of the box 30 and thus assuring maintenance of registration between the sprocket 72 and the chain carried by the box 30.

A paddle position sensor 88 is actuated by the chain in box 30 to provide an output on conductors 90 which indicates at all times the location of paddle 34 in box 30.

Box 30 is rotated by actuation of a pneumatic cylinder 92 and a four bar linkage. The lower end of the cylinder 92 is attached to the frame by a pin (not shown) to permit pivotal movement of the cylinder 92. A piston rod 96 is connected to a midpoint on an arm 98 by pin 97. One end of arm 98 is coupled to the frame by a pin 100. The other end is connected to an L-shaped bar 102. The other end of bar 102 is connected to an upstanding arm 108 which is fastened to box 30.

When cylinder 92 is actuated to retract piston rod 96 into cylinder 92, box 30 is rotated counterclockwise to an inverted position. When the piston rod 96 is driven upward, the box 30 is again rotated in a clockwise direction to its original position.

FIG. 3 is a back side view of the unit which, in FIG. 2 is shown from the front or operator's side. As seen in FIG. 12, motor 54 also drives a sprocket 120 through an angle gear arrangement (not shown). Sprocket 120 is coupled by way of chain 122 to a sprocket 124 which drives a chain 126 leading to a sprocket 128 on a shaft 130. Shaft 130 is an input drive shaft for a transfer mechanism in the transition unit 15.

In transition unit 15 a motor 140 is connected by way of a timing belt 142 to a gear box 144. As best seen in FIG. 2, bear box 144 has an output sprocket 146 which is coupled by way of a chain 148 to shaft 130. Thus, both motors 54 and 140 may drive the shaft 130.

Shaft 130 is coupled by a sprocket chain 150 to a sprocket 152 which is mounted for rotation on axis 154. A set of six sprockets of diameter larger than sprocket 152 is also mounted on pivots whose axes are aligned with axis 154. One such sprocket, the sprocket 156, may be seen in FIG. 2. Five like sprockets are also provided. A sprocket chain 158 is connected from sprocket 156 to a sprocket 160. Sprocket 160 is one of six sprockets mounted in alignment on an axis 162. A smaller sprocket 164 on axis 162 is connected by chain 166 to a like sprocket 168, mounted on axis 170. A total of six large and six small sprockets are mounted on axis 170, only one of which, sprocket 172, may be seen. A chain 174 is connected to sprocket 176 which is one of a set of six sprockets mounted on axis 178.

The large sprockets mounted on axes 154, 162, 170 and 178 all carry chains such as chains 158 and 174, which chains each carry two unloader fingers.

More particularly, as shown in FIG. 2, an unloader finger 186 is connected at its lower end to chain 158 by pin 188. It is also connected at a point below the tip thereof to chain 174 by pin 190 so that the tip of the finger 186 extends above the plane of the bottom of box 30 when moving in the direction of arrow 186*a*. There are three such fingers mounted in alignment with finger 186 to form a rank of fingers, which rank moves in the direction of arrow 186*a*. The fingers serve to push on the rear of a stack of mail which has been moved to the front end of box 30 by paddle 34.

Finger 180 is connected at point 182 to a second chain which is positioned behind chain 158 and to a second chain at point 184 which is positioned behind chain 174. There are two additional fingers similarly mounted on chains and in alignment with finger 180 to move as a rank in the return direction indicated by arrow 180*a*. It will be noted that the tip of finger 180 travels below the plane of the bed of the box 30. Thus, during the return trip the fingers do not interfere with mail being moved forward by the rank which includes finger 186. It will now be clear that the chains mounted on the sprockets which rotate on axes 154 and 162 support the lower extremities of the six fingers while the chains on sprockets which rotate on axes 170 and 178 support the six fingers at the midpoints thereof. The fingers are divided into two ranks of three fingers per rank. The two ranks are spaced apart along the chain by distance equal to one-half of the chain length.

Fingers 180 and 186 extend above the plane of the floor of box 30 during each orbit. Because shaft 178 is located under box 30, the fingers 180 and 186 must pass up through the bottom of box 30. In order to accommodate movement of fingers 180 and 186, the bottom of the box 30 is slotted at the front end. Paddle 34 and the bed of transition section 15 also are slotted so that fingers 180 and 186 may pass therethrough. As shown in FIG. 1, the bottom plate of box 30 has three slots 194, 196 and 198 extending to the front edge from a point beyond the periphery of sprocket 176 as viewed in FIG. 2.

Figure 5:
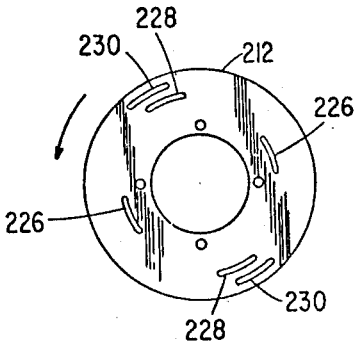
FIG. 5 is a view of one of the disks of the unit of FIG. 4.
Figure 4:
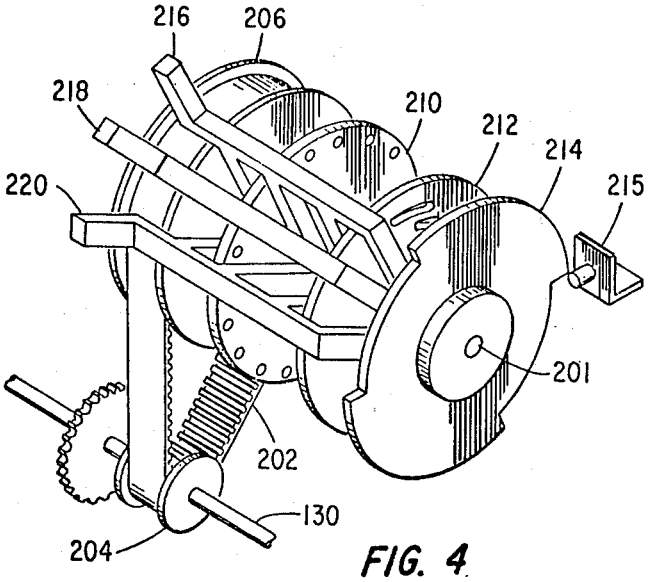
FIG. 4 is a diagrammatic view of a form of control system for the unit of FIG. 3.

Unit 10, FIG. 2, includes a control system including a sensor disk assembly 200 mounted for rotation on axis 201. Assembly 200 is shown in FIGS. 4 and 5. More particularly in FIG. 4, shaft 130, also seen in FIG. 2, also serves to drive a timing belt 202 from a timing pulley 204. Belt 202 drives a pulley 206 which is mounted on a shaft 208. Shaft 208 also carries two code disks 210 and 212 and a proximity switch cam 214. A guard band sensor bar 216 has fingers which extend over code disks 210 and 212. A paddle motor sensor bar 218 has similar fingers. A speed sensor bar 220 also has similar fingers encompassing the code disks 210 and 212.

Disk 212 shown in FIG. 5 has arcuate slots therein. Slots 226 are on a small radius located diametrically opposite each other and extend approximately 30°. Slots 228 are on an intermediate diameter and are slightly offset from aquadrature relation with respect to slots 226. Slots 230 are on a larger diameter and are oriented in quadrature relation to slots 226. Slots 230 pass light from a lamp on arm 222 to a sensor on arm 224 rapidly to rotate the drive of chains 174 and 158 through a long step to lower the lead rank of fingers and raise the trailing rank when the ranks approach opposite ends of the traverse thereof. Light passing through slots 228 is sensed to inhibit rotation of box 30. Light passing through slots 226 is sensed to permit rotation of box 30. Light passing through holes in disk 210 is sensed to energize the drive for chains 158 and 174 to advance the stack ahead of a rank of fingers a short preset step. The output signals from sensors adjacent holes in disk 210 and slot 230 are ORed together in gate 289 to drive motor 144.

In operation, trays preferably will be loaded automatically, but may be loaded into box 30 by hand. When automatic loading is used, a request command is given to load a tray into the box 30.

The request command is a function of (1) the box paddle being in the forward position, (2) a tray-in-box photocell path being unobstructed, (3) the guardband sensor of unit 200 being properly positioned, (4) the mail pan raised and (5) the box 30 being stationary.

Each command to release and load a tray into the box 30 is initiated by the sensor unit 200. The command to release and load comes only after the transition fingers 180 or 186 have cleared the slots in the front of box 30, thereby clearing the last of the mail items dumped the previous cycle. The front end of the tray must be inserted all the way to the forward end of box 30. In FIG. 2, a photocell sensor 51*a* mounted adjacent standard 51 detects tray presence. Sensor 51*a* is located near the forward end of box 30 at the operator side of unit 10. A light source 51*b*, FIG. 3, is mounted in alignment with holes (not shown), as is sensor 51*a*. When a tray is fully inserted in box 30, the light beam is interrupted and sensor 51*a* then responds, indicating a tray is present. The mail pan lowers to trap the mail in the tray and box 30 rotates 180° counterclockwise (as observed from the rear end) in approximately 0.7 seconds. The mail pieces are then lowered from the tray on the mail pan into what is now the bottom of the box.

Paddle 34 is now in back of the mail ready to push it out of the box to the transition unit 15. The signal to drive the paddle forward and unload the mail from the box comes from the sensor on bar 218. The sensor initiates this command when the transition fingers 180, 186 are out of the guardband or finger protect region. The forward end of the stack of mail pieces overtakes the transition fingers and is set in the upright position. A switch in the center finger senses the mail and deenergizes the high speed paddle drive to keep the mail from being pushed over the top of the fingers. The paddle continues to discharge the mail in response to servo motor 74 to the transition unit until it reaches the end of its travel. The continued feeding of the mail through the transition unit is then taken over by the next set of fingers.

As soon as the fingers are clear of box 30, the complete cycle is repeated. The rate at which the transition fingers feed the mail is a function of a signal gererated by a feeder module (not shown). The signal is initiated on a demand basis as required by the feeder.

Figure 6:
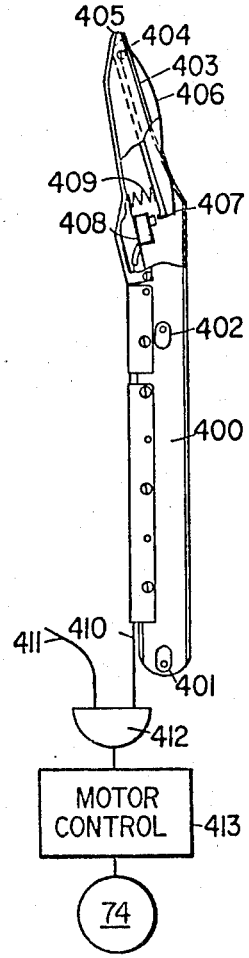
FIG. 6 illustrates a preferred form of an unloader finger and motor control.

In FIG. 2 fingers 180 and 186 are mounted on chains 158 and 174. The tips of the fingers pass upward through slots in the bottom of box 30 contacting the mail pieces 14 to move the mail out of box 30 and into a transition section 15. If the pressure applied to finger 186, FIG. 2, is too great, the trailing stack of mail of finger 186, FIG. 2, will be compressed and cause the stack to buckle upward and be ejected from the transition section 15 or otherwise disabled from processing. Such disabling action is forestalled by use of controls which include fingers of the type illustrated in FIG. 6. In FIG. 6, the finger body 400 is provided with holes 401 and 402 to journal pivot pins, such as pins 188 and 190 of FIG. 2. The face 403 of the tip of finger 400 is positioned for contact by the trailing stack of mail. Face 403 is concave and finger body 400 is hollow. A pin 404 near the tip 405 pivots a lever 406 which is convex and extends out beyond the concave boundary 403. The end 407 of lever 406 serves to actuate a microswitch 408 which is mounted in the finger 400. A spring 409 serves to determine the pressure from lever 406 to actuate switch 408. Switch 408 is then connected by way of cable 410 to control motor 74 which drives paddle 34. The control is such that when lever 406 actuates switch 408 at a predetermined pressure determined by spring 409, the drive applied to paddle 34 will be terminated so that the pressure on the trailing stack will not exceed a limit determined by spring 409. The circuit to which cable 410 leads is such that when the lever in any of the fingers mounted on chains 158 and 174 applies a predetermined pressure on the mail being pushed against it, drive motor 74 will stop.

Thus, the fingers 180 and 186 of FIG. 2 preferably will be constructed in accordance with the details illustrated in FIG. 6. Two such fingers may be connected through AND logic circuit to the controls for the motor. As indicated schematically in FIG. 6 where cables 410 and 411 lead to an AND gate 412. The output of AND gate 412 leads to the control 413 for the motor.

In an alternative form of control, the finger 400 may be reversed to position the face on which lever 406 is exposed to push the stack ahead of it. In this mode, pressure on the stack may be sensed to stop motor 144 which drives chains 158 and 174.

The present application relates to the control of movement of fingers 180 and 186 in response to pressure from a trailing stack.

The system in which fingers, such as fingers 180 and 186, cooperate with the mail turnover box and the paddle in the turnover box so that the fingers can pass upwards through slots in the box and push the stack away from the paddle and out of the box is also described and is claimed in pending U.S. application Ser. No. 385,295, filed Aug. 3, 1973 by Donald F. Renfrow, entitled "Batch to Continuous Flow Mail Handling", assigned to the assignee of the present invention.

The specific method and system for unloading a mail tray by inserting it in a turnover box while maintaining a stack of mail in an ordered array is also described and is claimed in copending U.S. application Ser. No. 385,466, filed Aug. 3, 1973 by Edward T. Hunter et al, entitled "Mail Tray Unloading", assigned to the assignee of the present invention.

Having described the invention in connection with certain specific embodiments thereof, it is to be understood that further modifications may now suggest themselves to those skilled in the art and it is intended to cover such modifications as fall within the scope of the appended claims.

What is claimed is:

1. A system for handling edge supported stacks of mail comprising:

a. a transport bed having longitudinal slots, b. spaced ranks of upstanding fingers having mounting means to follow a closed course having an upper traverse arranged so that the tips of one rank of fingers at a time extend up through said bed and contact the rear of each stack, c. first motor means to drive said fingers to push against the rear of the preceding stack, d. second motor means and means driven by said second motor means to move a trailing stack toward the rear of said preceding stack, and e. pressure responsive means at the contact between at least one finger in each rank and one said stack to discontinue the drive by one of said motor means when said pressure reaches a predetermined level, said pressure responsive means faces the front of said trailing stack to control said second motor.

2. The combination set forth in claim 1 in which means are provided to actuate said first motor repeatedly in a succession of short steps in response to demand with means to drive said motor through two long steps in each revolution of a given rank, which long step occurs when each said rank approaches the end of said upper traverse abruptly to lower the rank at the end and raise the rank at the beginning of said upper traverse and means to sense and transmit said demand to said first motor.

* * * * *